US012065848B2

(12) United States Patent
Xue

(10) Patent No.: US 12,065,848 B2
(45) Date of Patent: Aug. 20, 2024

(54) UMBRELLA ASSEMBLY AND UMBRELLA STABILITY ASSEMBLY

(71) Applicant: ShelterLogic Corp., Watertown, CT (US)

(72) Inventor: Ning Xue, Newtown, CT (US)

(73) Assignee: ShelterLogic Corp., Watertown, CT (US)

( * ) Notice: Subject to any disclaimer, the term of this patent is extended or adjusted under 35 U.S.C. 154(b) by 79 days.

(21) Appl. No.: 17/745,967

(22) Filed: May 17, 2022

(65) Prior Publication Data

US 2022/0372782 A1 Nov. 24, 2022

Related U.S. Application Data

(60) Provisional application No. 63/190,279, filed on May 19, 2021.

(51) Int. Cl.
*E04H 15/22* (2006.01)
*A45B 23/00* (2006.01)
*E04H 12/22* (2006.01)

(52) U.S. Cl.
CPC ..... *E04H 12/2223* (2013.01); *A45B 23/00* (2013.01); *E04H 12/2246* (2013.01); *A45B 2023/0012* (2013.01)

(58) Field of Classification Search
CPC ..... E04H 12/223; E04H 12/2223; E04H 12/2238; E04H 12/2246; E04H 12/2269; A45B 2023/0012; A45B 23/00
USPC ..... 52/157; 248/530, 533, 156, 910
See application file for complete search history.

(56) References Cited

U.S. PATENT DOCUMENTS 155,235 A * 9/1874 Goldsmith ..... E04H 15/62 248/156
4,753,411 A * 6/1988 Lechner ..... E04H 12/2215 52/165
4,850,564 A * 7/1989 Padin ..... E04H 12/2223 248/533

(Continued)

FOREIGN PATENT DOCUMENTS

CN 2610721 * 4/2004
WO WO 2011/030171 * 3/2011
WO WO 2020/152213 * 8/2020

*Primary Examiner* — Robert Canfield
(74) *Attorney, Agent, or Firm* — Carmody Torrance Sandak & Hennessey LLP

(57) ABSTRACT

An umbrella assembly including a central shaft, the central shaft having a first end and a second end opposite the first end; a canopy coupled to the first end of the central shaft; an auger extending from the second end of the central shaft; a collar/hub nonslideably coupled to the central shaft and spaced from the auger; a plurality of legs, each of the plurality of legs having a first end and a second end; wherein the first end of each of the plurality of legs is coupled to the collar/hub, the second end of each of the plurality of legs extends towards the auger, and the collar/hub remains in a fixed position with respect to the central shaft when the second end of each leg extends outwardly from the central shaft to a deployed position and returns towards the central shaft from its deployed position to a stowed position; and a flexible material having an opening through which the central shaft extends and wherein the second end of each leg is coupled to the flexible material.

18 Claims, 8 Drawing Sheets

(56) References Cited

U.S. PATENT DOCUMENTS 5,090,435 A * 2/1992 Leclercq ..... A45B 23/00 135/149
5,293,889 A * 3/1994 Hall ..... A45B 3/00 248/533
5,339,847 A * 8/1994 Kanter ..... A45B 23/00 248/533
5,452,877 A * 9/1995 Riffle ..... E04H 12/2246 135/902
5,884,645 A * 3/1999 Chen ..... A45B 19/04 135/25.1
5,979,844 A * 11/1999 Hopkins ..... E01F 9/692 248/910
6,164,613 A * 12/2000 Williams ..... E04H 12/2246 248/533
6,502,257 B1 * 1/2003 Glenn ..... A47G 9/062 5/418
8,047,217 B1 * 11/2011 Schermerhorn, Jr. ..... E04H 12/2215 248/910
8,191,561 B2 * 6/2012 Brooks, III ..... E04H 12/2223 248/533
9,179,745 B2 * 11/2015 Berland ..... E04H 12/2223
9,974,369 B1 * 5/2018 DePaolo ..... E04H 12/2246
10,125,513 B2 * 11/2018 Jecel ..... E04H 12/2269
10,753,115 B2 * 8/2020 Perreault ..... A45B 23/00
10,767,385 B2 9/2020 Wehr
11,402,059 B2 * 8/2022 Yeomans ..... F16M 11/38
11,559,135 B1 * 1/2023 Taylor ..... A45B 23/00
2007/0131824 A1 * 6/2007 Harold ..... A45B 25/00 248/156
2015/0159337 A1 * 6/2015 Kellner ..... E02D 5/80 248/156
2017/0086544 A1 3/2017 Martel
2019/0037984 A1 * 2/2019 Lake ..... A45B 23/00
2019/0338549 A1 * 11/2019 McDermott ..... E02D 5/801
2022/0127872 A1 * 4/2022 Chen ..... E04H 12/2223

* cited by examiner

UMBRELLA ASSEMBLY AND UMBRELLA STABILITY ASSEMBLY

BACKGROUND OF THE INVENTION

The present invention relates generally to umbrellas, and more particularly, to an improved umbrella construction, preferably for but not limited to the beach.

Beach umbrellas, as well as tripod stands for umbrellas (beach or otherwise) are well known in the art. Designers and inventors have for years been trying to design and construct a beach umbrella that achieves a plurality of objectives while remaining within desirable manufacturing cost constraints. Examples of prior art pole or shaft anchors can be found in U.S. Pat. No. 6,164,613, U.S. Publication No. 2019/0338549 and U.S. Pat. No. 10,767,385. However, it is believed that an optimal beach umbrella has eluded these past designers and inventors.

It is therefore desirable to provide a beach umbrella that overcomes the deficiencies in the prior art, not the least of which is to provide an umbrella that is easy to use, set up, secure in the ground (e.g. sand) and that adequately resists damage and/or being uprooted from its "planted" position by the wind. It is believed that the present invention achieves the foregoing objectives as well as others as will be disclosed herein.

SUMMARY AND OBJECTIVES OF THE INVENTION

It is thus an objective of the present invention to overcome the perceived deficiencies in the prior art.

Specifically, it is an objective of the present invention to provide an umbrella, preferably but not exclusively for the beach, that is easy to use, set up, secure in the ground (e.g. sand) and that adequately resists damage and/or being uprooted from its "planted" position by the wind.

Other objectives and advantages of the present invention will become more apparent from a consideration of the drawings and ensuing disclosure.

To overcome the perceived deficiencies in the prior art and to achieve the objectives and advantages as set forth herein, the present invention is, generally speaking, directed to an umbrella assembly. In a first preferred embodiment, the invention is directed to an umbrella assembly comprising a central shaft, the central shaft having a first end and a second end opposite the first end; a canopy coupled to the first end of the central shaft; an auger extending from the second end of the central shaft; a collar/hub nonslideably coupled to the central shaft and spaced from the auger; a plurality of legs, each of the plurality of legs having a first end and a second end; wherein the first end of each of the plurality of legs is coupled to the collar/hub, the second end of each of the plurality of legs extends towards the auger, and the collar/hub remains in a fixed position with respect to the central shaft when the second end of each leg extends outwardly from the central shaft to a deployed position and returns towards the central shaft from its deployed position to a stowed position; and a flexible material having an opening through which the central shaft extends and wherein the second end of each leg is coupled to the flexible material.

In one or more preferred embodiments, the umbrella assembly comprises a first shaft having a first end and a second end, wherein the canopy is coupled to the first end of the first shaft and wherein the second end of the first shaft is coupled to the first end of the central shaft. In another preferred embodiment, the canopy may be directly coupled to the first end of the central shaft (e.g. without the need for the first shaft).

In another preferred embodiment, the present invention is directed to an umbrella stability assembly for use with an umbrella, wherein the umbrella stability assembly comprises a shaft, a canopy coupled to one end of the shaft, and an auger coupled to the other end of the shaft; wherein the umbrella stability assembly comprises a collar/hub nonslideably coupled to the central shaft and spaced from the auger; a plurality of legs, each of the plurality of legs having a first end and a second end; wherein the first end of each of the plurality of legs is coupled to the collar/hub, the second end of each of the plurality of legs extends towards the auger, and the collar/hub remains in a fixed position with respect to the central shaft when the second end of each leg extends outwardly from the central shaft to a deployed position and returns towards the central shaft from its deployed position to a stowed position; and a flexible material having an opening through which the shaft extends and wherein the second end of each leg is coupled to the flexible material.

Any combination or permutation of features, functions and/or embodiments as disclosed herein is envisioned. Additional advantageous features, functions and applications of the disclosed assemblies and methods of the present invention will be apparent from the disclosure that follows, particularly when read in conjunction with the appended figures.

The invention accordingly comprises the features, combinations of elements and features, arrangement of parts and methods for using the same which will be exemplified in the description and illustrations hereinafter set forth, and the scope of the invention will be indicated in the claims.

BRIEF DESCRIPTION OF THE DRAWINGS

The above set forth and other features of the present invention are made more apparent in the ensuing Description of the Preferred Embodiments when read in conjunction with the attached Drawings, wherein.

Figure 7:
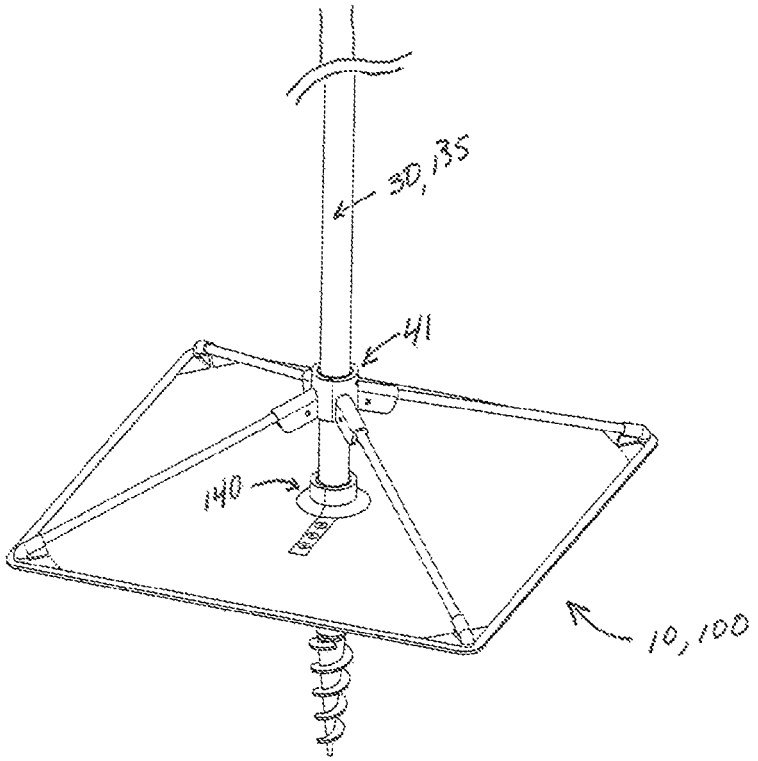
Figure 7A:
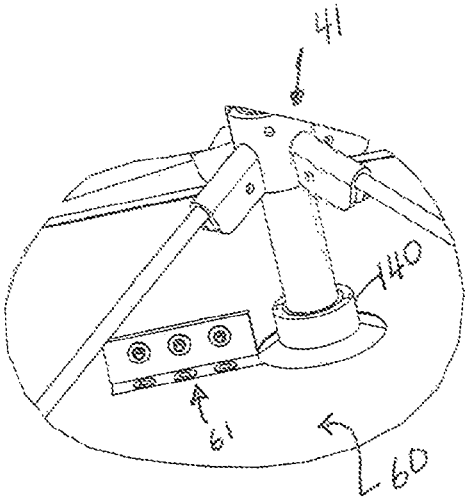
Figure 8:
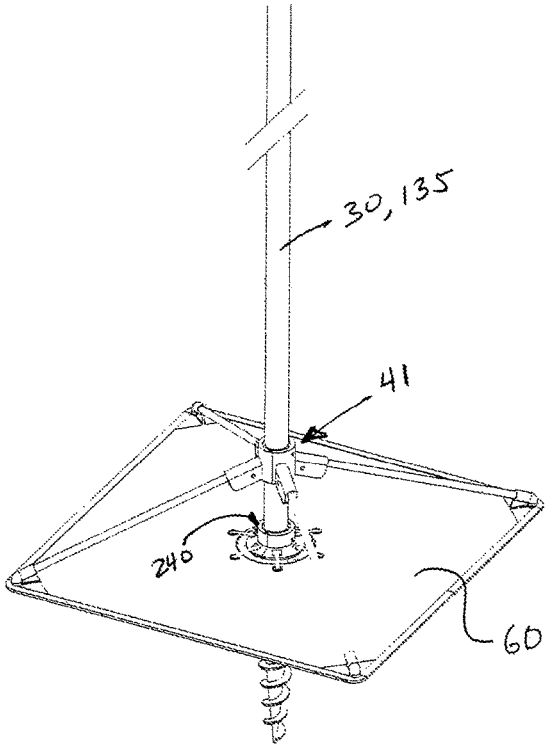
Figure 8A:
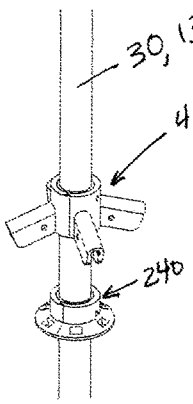
Figure 8B:
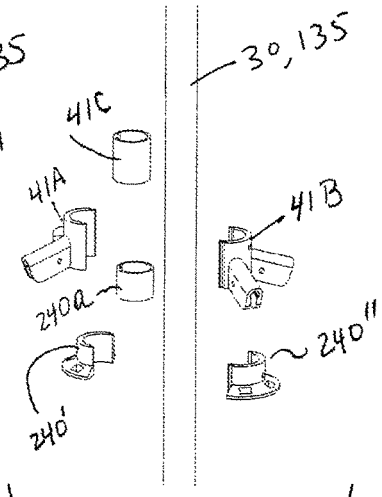

1-4, in which the canopy is directly coupled to a central shaft as disclosed herein (e.g. without the need for a separate first shaft);

FIG. 7 shows an alternative collar/hub 41 construction and a collar 140 construction in accordance with, and that may be advantageously incorporated into, preferred embodiments of the present invention;

FIG. 7A illustrates a preferred specific embodiment of the flexible material 60 illustrating the use of one or more snaps or other means (e.g. Velcro, buttons, clips, adhesive, etc.) to support and secure the flexible material 60 on the shaft 30 using collar 140;

FIG. 8 shows the alternative collar/hub 41 construction and yet an additional and/or alternative collar 240 construction in accordance with, and that may be advantageously incorporated into, preferred embodiments of the present invention; and FIGS. 8A, 8B show features of the alternative collar/hub 41 construction and the collar 240 construction illustrated in FIG. 8.

Identical reference numerals in the figures are intended to indicate like parts, although not every feature in every figure may be called out with a reference numeral.

DETAILED DESCRIPTION OF THE PREFERRED EMBODIMENTS

Reference is made to the Figures in connection with the following disclosure for an understanding of preferred embodiments of the present invention.

Figure 1:
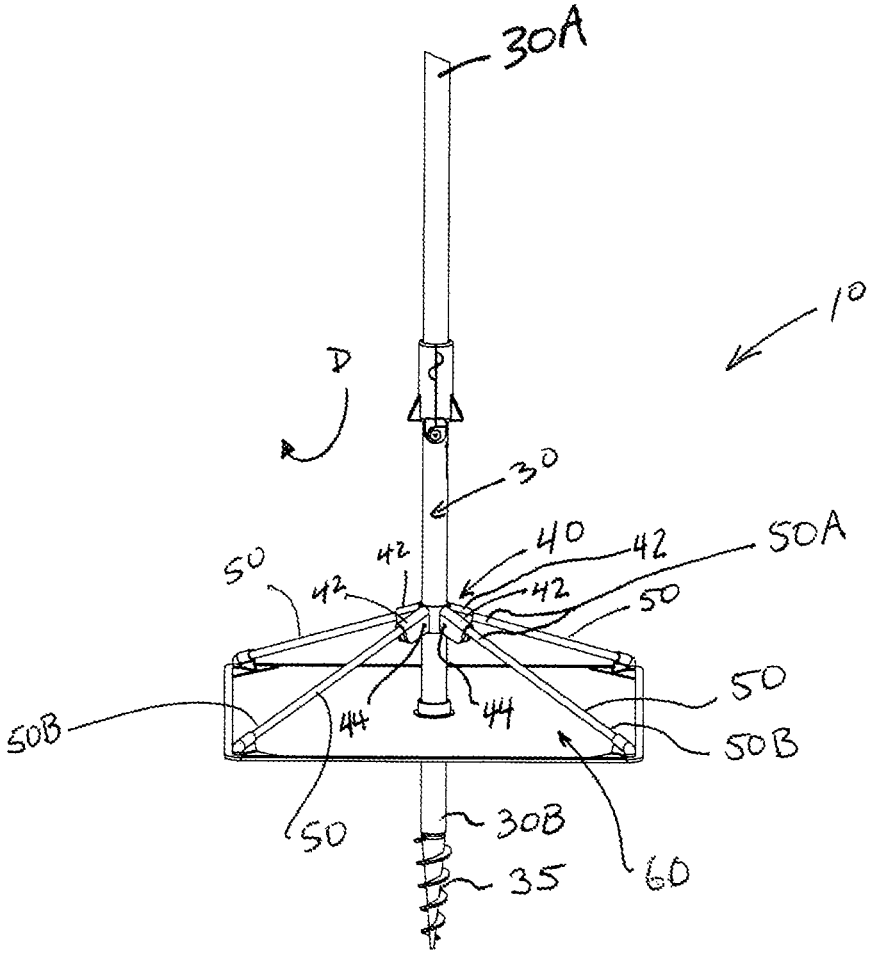
FIG. 1 is a perspective view of a portion of an umbrella assembly (and a beach umbrella assembly as a preferred embodiment), constructed in accordance with preferred embodiments of the present invention, illustrating the legs in a deployed position.
Figure 5:
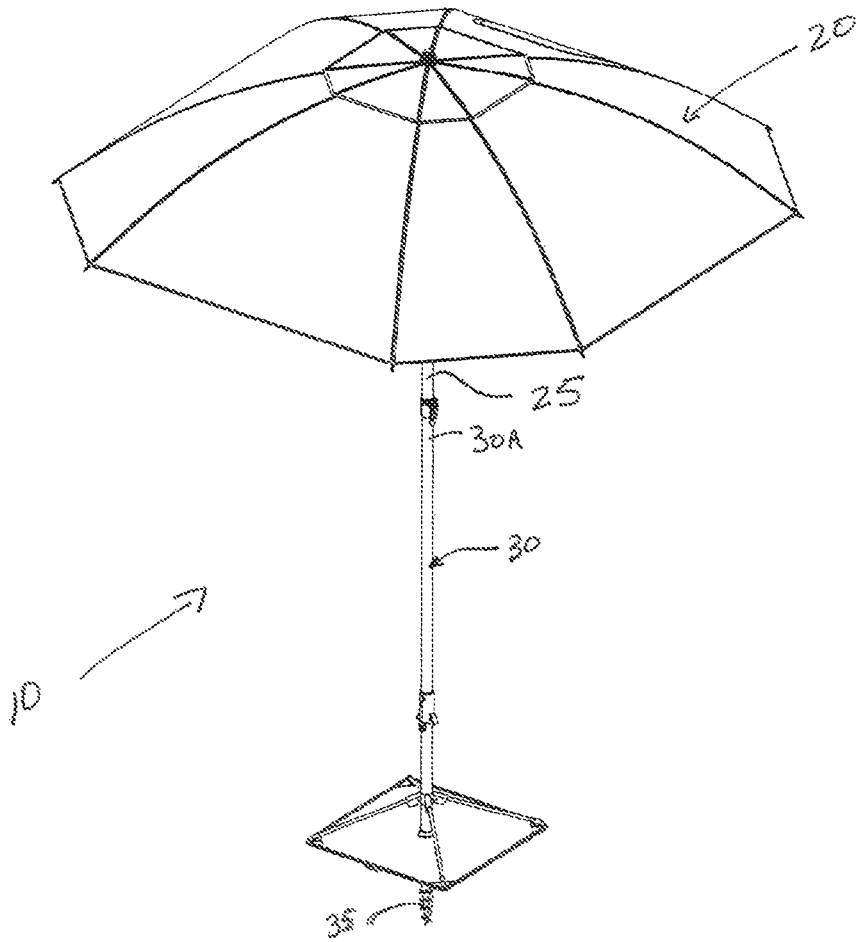
FIG. 5 is a perspective view of a fully constructed umbrella assembly (and a beach umbrella assembly as a preferred embodiment), constructed in accordance with all the preferred embodiments of the present invention and is intended to show and shall be deemed to disclose, as does the text below, an umbrella assembly in which the canopy is coupled to a first shaft, and wherein the first shaft is coupled (telescopically or otherwise) to a central shaft as disclosed herein.

In a plurality of preferred embodiments, the present invention is directed to an umbrella assembly generally indicated at 10 and shown in FIG. 5, among other figures. Umbrella assembly 10 is preferably but not necessarily a beach umbrella. In such preferred embodiments, umbrella assembly 10 comprises a canopy 20 coupled to a first shaft 25. The assembly 10 in such embodiments also comprises a central shaft, generally indicated at 30, having a first end 30A and a second end 30B (e.g. see FIG. 1) opposite the first end 30A. In such preferred embodiments, the first shaft 25 is preferably telescopically couplable to the first end 30A of the central shaft 30. An auger 35 extends from the second end 30B of the central shaft 30.

Umbrella assembly 10 also includes a collar/hub generally indicated at 40, positioned on the central shaft 30 and spaced from the auger 35. In preferred embodiments, collar/hub 40 is preferably a one (1) piece collar/hub (but could also be a two (2) or multipiece collar/hub as would be understood in the art). Importantly, collar/hub 40 is preferably secured and nonslideable along central shaft 30 by means of rivets, nut/bolt combinations, or any other known means, most preferably at the time of manufacturing and/or originally constructing the umbrella assembly 10. In this way, and as further disclosed below, collar/hub 40 is nonslideably coupled with respect to (and positioned on) to the central shaft 30 as the second end of each leg is extended outwardly from the central shaft 30 to a deployed position and returned towards the central shaft 30 from its deployed position to a stowed position.

Preferably, collar/hub 40 includes a plurality of leg receptacles 42 radially extending from the collar/hub 40. The number of leg receptacles 42 is dependent upon the number of legs used, as will be disclosed below. Preferably, there is one leg receptacle 42 for each leg of the umbrella 10. Each leg receptacle 42 includes a pin 44 extending therethrough, upon which each leg is hingedly (or i.e. rotatably) coupled so as to permit the respective legs to be deployed and returned as will now be disclosed.

Figure 2:
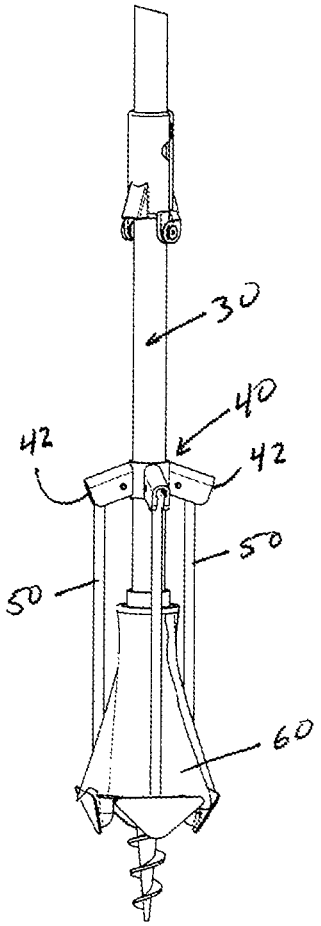
FIG. 2 is a perspective view of the portion of the umbrella of FIG. 1 illustrating the legs in a stowed position.
Figure 3:
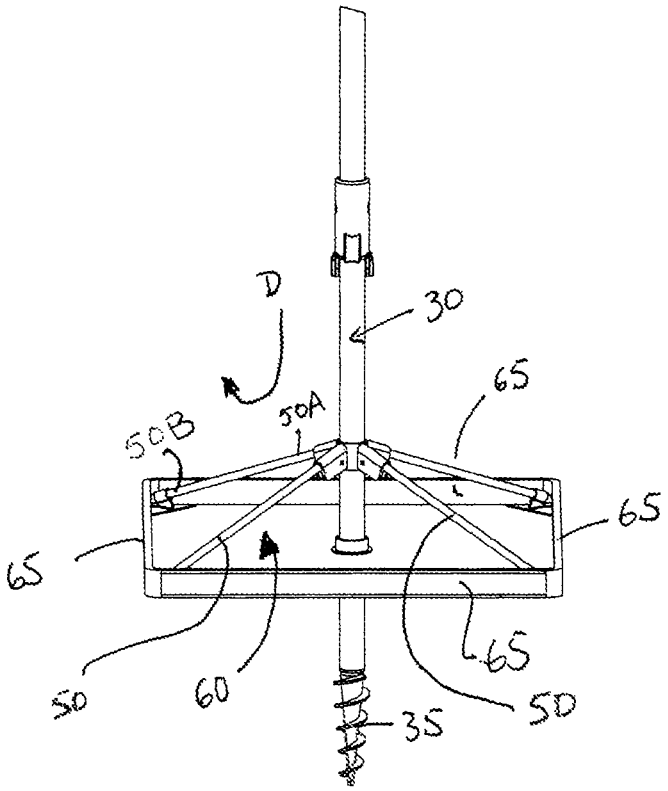
FIG. 3 is a perspective view of a portion of an umbrella assembly (and a beach umbrella assembly as a preferred embodiment), constructed in accordance with additional preferred embodiments of the present invention, illustrating the legs in a deployed position.
Figure 4:
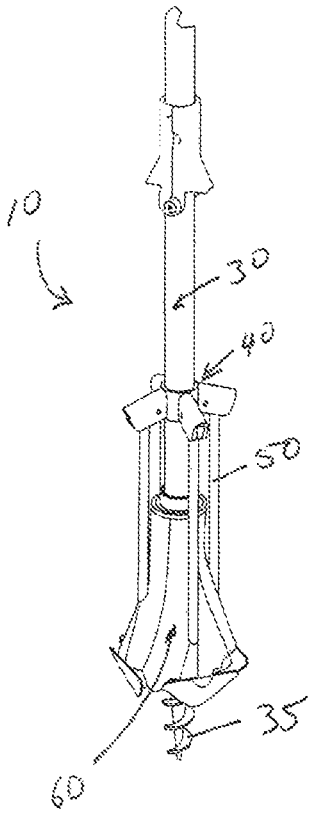
FIG. 4 is a perspective view of the portion of the umbrella assembly of FIG. 3 illustrating the legs in a stowed position.

That is umbrella 10 also includes a plurality of the aforementioned legs 50, each of the plurality of legs 50 having a first end 50A and a second end 50B, wherein the first end 50A of each of the plurality of legs 50 is hingedly (or i.e. rotatably) coupled to the collar/hub 40 by having the respective pin 44 going through respective holes in the respective sides of first end 50A of each leg 50 so that the second end 50B of each leg 50 can be extended outwardly from the central shaft 30 to a deployed position (i.e. FIGS. 1, 3) and returned (e.g. retracted) towards the central shaft 30 from its deployed position to a stowed position (i.e. FIGS. 2, 4).

Umbrella 10 also includes a flexible material 60, in the shape of a square, circle or any other shape (merely dictated by the number of legs 50), having an opening through which the central shaft 30 extends and wherein the second end 50B of each leg 50 is coupled to the flexible material 60. Preferably, each second end 50B is coupled to the flexible material 60 about the perimeter thereof (e.g. along the corners (e.g. in the shape of a square) or otherwise edges of the flexible material 60). This is preferably achieved by snaps, rivets, buttons, and/or other adhesive, connecting and/or permanent or removable coupling means therefor. Reinforcement of the flexible material 60 or "leg pockets" may be provided at the corners thereof for increased structural integrity.

In this way, it can be seen that extension of the plurality of legs 50 outwardly from the central shaft 30 to their respective deployed positions (see FIGS. 1, 3 generally) opens the flexible material 60 (or otherwise extends the flexible material 60 to an open position). Relatedly, returning or otherwise retraction of the plurality of legs 50 towards the central shaft 30 from their respective deployed position to their respective stowed positions (see FIGS. 2, 4 generally) causes the flexible material 60 to return to a collapsed position (e.g. "bunch up").

As can be seen in the figures, the collar/hub 40 is positioned such that with the second ends 50B of the legs 50 in each of their respective deployed positions (e.g. FIGS. 1, 3) and with the flexible material 60 in its open position (also as in FIGS. 1, 3), the flexible material 60 is intermediate the auger 35 and the collar/hub 40. As can be seen in the figures and should now be understood by those skilled in the art, the collar/hub 40 is nonslideably coupled to the central shaft 30 and spaced from the auger 35, wherein the collar/hub 40 remains in a fixed position with respect to the central shaft 30 when the second end 50B of each leg 50 extends outwardly from the central shaft 30 to a deployed position and returns towards the central shaft 30 from its deployed position to a stowed position.

The preferred and claimed construction is also distinguishable from embodiments such as that described in U.S. Publication No. 2019/0338549 with respect to legs 22 therein, which are deployed downwardly/outwardly from the central shaft, which is in patentable distinction to the construction disclosed in the present application in which the legs 50 are upwardly/outwardly deployed (i.e. in the direction of arrow "D" of FIGS. 1, 3) from the central shaft 30. It is these preferred embodiments and claimed construction, and all as shown in the figures of the present application, all of which disclose that the second end 50B of each of the plurality of legs 50B extends towards the auger 35 (as opposed to extending "away" from the auger as described in the aforementioned US Publication No. 2019/0338549).

In yet an alternative preferred embodiment of the umbrella assembly and as illustrated in FIGS. 3 and 4, the flexible material 60 may include an extended sidewall 65 to facilitate retention of material (e.g. sand, dirt, rocks, etc.) placed on the flexible material 60 within an area bounded by the extended sidewall 65. In a preferred embodiment, the extended sidewall 65 extends along the entire perimeter of the flexible material 60. The extended sidewall may be stitched or otherwise coupled or connected to (and/or alternatively, unitary with) the flexible material 60.

In preferred embodiments, the flexible material 60 and the extended sidewall 65 are each and/or both preferably made of fabric, plastic and/or other well-known flexible material suitable for the beach or otherwise outdoors.

Figure 6:
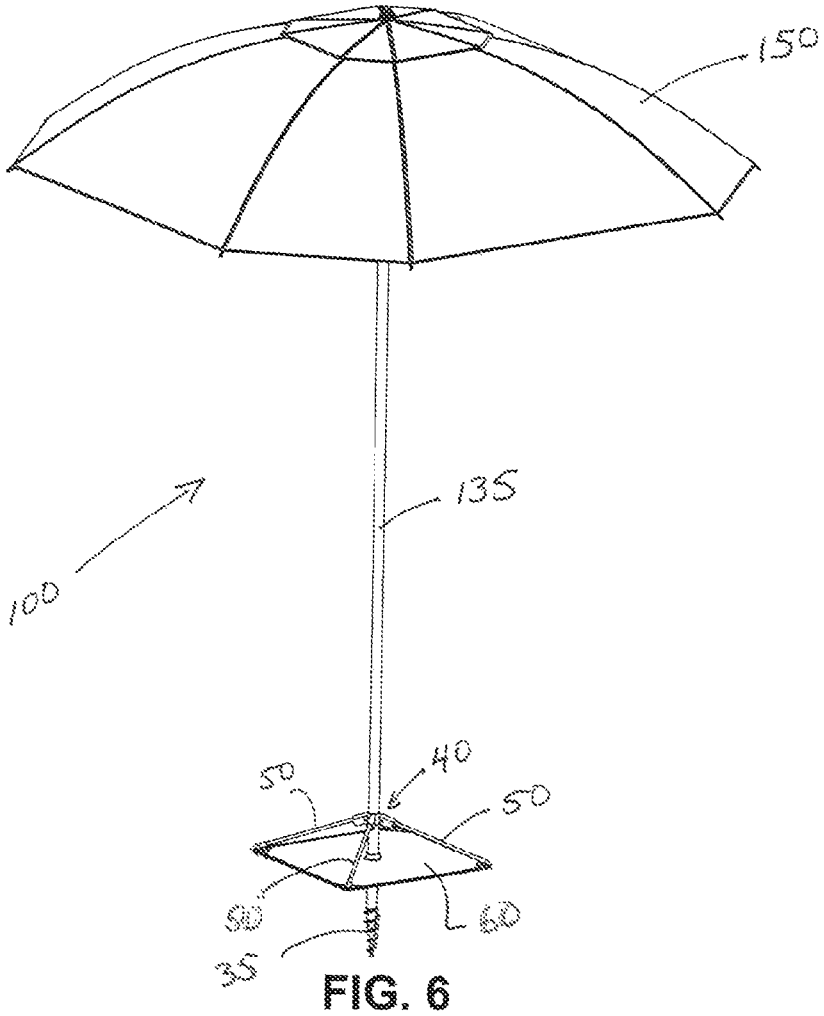
FIG. 6 is a perspective view of another preferred embodiment of a fully constructed umbrella assembly (and a beach umbrella assembly as a preferred embodiment), constructed in accordance with all the preferred embodiments of FIGS.

Reference is now briefly made to FIG. 6, which illustrates another alternative preferred embodiment of an umbrella assembly, generally indicated at 100, constructed in accordance with the present invention. In this alternative preferred embodiment, the central shaft 135 may have the canopy 150 coupled directly to the first end of the central shaft 135 (e.g. without the need for a separate first shaft 25). In all other respects, the details and alternatives with respect to the aforementioned embodiments are also applicable and apply to the umbrella assembly embodiment of FIG. 6, such that the embodiment of FIG. 6 may be used and shall be deemed herein to be disclosed in and applicable with the embodiments of FIGS. 1-4.

FIGS. 7, 7A, 8, 8A, 8B show a few features in accordance with alternative preferred embodiments of the present invention. For example, FIGS. 7, 7A, 8, 8A, 8B illustrate a collar/hub, generally indicated at 41, which is preferably comprised of two (2) half members 41A and 41B with a collar 40C being incorporated therebetween, as shown more particularly in FIG. 8B. Half members 41A, 41B may be snapped together and/or otherwise coupled together, as would be understood in the art after a review of the figures herein. This embodiment is particularly advantageous if the features of the present invention are sold as accessories for use with a standard/conventional umbrella, thereby permitting a user to incorporate the present invention with a standard/conventional umbrella. Of course, collar/hub 40 and/or collar/hub 41 can be used with each/all of the embodiments disclosed herein. Preferably, and as with collar/hub 40, collar/hub 41 is secured to and nonslideable with respect to shaft 30, 135, which can be achieved by the aforementioned means (e.g. rivets/bolts/screws, etc.) disclosed above and/or press-fitting/friction fitting or the like.

FIG. 7 also shows a further collar, generally indicated at 140, which may be "friction fit" and/or otherwise secured to shaft 30, 135 (for umbrella assembly 10 and/or umbrella assembly 100), and can help facilitate the support and/or positioning of the flexible material 60 on the first shaft 30, 135 and/or ensure that the material 60 does not "ride up or down" shaft 30, 135.

FIG. 7A highlights one possible means of securing the flexible material 60 about the shaft 30, 135, i.e. with collar 140 having a slot therein that can be more easily secured about the shaft 30, 135, after which the flexible material 60 can be more tautly secured to the shaft 30, 135 by the use of snaps 61 (as shown), buttons, Velcro, adhesives and/or other means as would be understood by those skilled in the art.

That is, collar 140 can also be used to help support the flexible material 60 on the first shaft 30, 135 by, for example, having a slotted feature (not shown) within which the flexible material 60 is sandwiched while the collar 140 is in place on the shaft 30, 135. Here again, the use of snaps, buttons, adhesive, Velcro or the like can be used to help tautly secure the flexible material 60 about the shaft 30, 135. Other uses, advantages of collar 140 may be recognized by the incorporation thereof.

Still further, in place of collar 140 another preferred collar assembly, generally indicated at 240, and constructed as shown in FIGS. 8, 8A, 8B may be used. In this embodiment, one or more cords, made of nylon, cord, string, or the like, may be used to "tie" the flexible material 60 to collar assembly 240. And, with collar assembly 240 "friction fit," snap-fit, and/or otherwise secured to and nonslideable with respect to shaft 30, 135 as shown in the figures, it is further assured that flexible material 60 will remain properly secured to and positioned on shaft 30. As also shown, a plurality of holes and/or metal or plastic "eyelets" may be provided on/in flexible material 60 to help prevent or minimize tearing or ripping of the flexible material 60. As most easily shown in FIGS. 8A, 8B, collar assembly 240 may be comprised of two (2) half members 240' and 240" with a collar 240*a* being incorporated therebetween to help secure the nonslideable feature and functionality thereof onto shaft 30, 135. Such half members 240', 240" may likewise be respectively snapped together and/or otherwise coupled together, as would be understood in the art after a review of the figures herein.

One advantage of using collar assembly 240 is that the fabric material 60 need not include the aforementioned slit/snaps, etc., as the hole in the material 60 may be larger than the auger, with the nylon cords, etc. keeping it together.

As can now be seen by the disclosed embodiments, the present provides significant and numerous improvements and advantages over the prior art, which include and are not limited to improved resistance to damage and/or injury caused by the wind against the umbrella during usage thereof. For example, by allowing the flexible material 60 to remain flat on the sand or other surface upon which sand, rocks, earth and/or other material can be placed, improved stability and resistance to undesirable removal from the sand or other surface is achieved. The inclusion of the sidewall 65 further increases the likelihood of maintaining the sand, rocks and/or earth in position on the material 60 without inadvertent removal thereof. The nonslideable nature of collar 40, 41 and/or the other collars disclosed herein also makes clear that the present invention is constructed differently and in a non-obvious manner from that described in U.S. Pat. No. 6,164,613 for the nonslideable nature of the collar/hubs 40, 41 and for the other differences disclosed herein.

To be sure, the preferred embodiments of the present invention all include the important functional and constructional differences from that described in the prior art, which include, but are not limited to, a collar/hub that is coupled to the central shaft and spaced from the auger; wherein the collar/hub is prevented from sliding along the central shaft by means of rivets, screws, nuts/bolts, adhesives, friction and/or pressure fitting and/or other securing means disclosed herein and/or contemplated by those skilled in the art by virtue of the disclosure and/or suggestions herein and/or by any other known or hereinafter developed means, and wherein each of the first end of each of the plurality of legs is coupled to the collar/hub and the second end of each of the plurality of legs extends towards the auger, and wherein the collar/hub remains in a fixed position with respect to the central shaft when/as the second end of each leg extends upwardly (from a reference point of the auger being below the hub as if the auger was about to be "planted" in the ground/sand) and outwardly from the central shaft to a deployed position and returns towards the central shaft from its deployed position to a stowed position.

It should also be understood that use of the terminology "umbrella" and "umbrella assembly" are interchangeable as used and contemplated herein.

In addition, it can now also be appreciated that the features of the present invention, i.e. the umbrella stability assembly, can and/or may be sold as accessories for use with a conventional (e.g. beach) umbrella. Such constructions allow for the present invention to be retrofitted onto existing and conventional umbrellas to improve and increase the functionality, use, advantages, and enjoyment thereof.

The features and aspects of embodiments are disclosed herein with reference to the accompanying drawings, in which elements are not necessarily depicted to scale, and in certain views, parts may have been exaggerated or removed for purposes of clarity. It is to be noted that the various features, steps and combinations of features/steps disclosed herein can be arranged and organized differently to result in embodiments which are still within the scope of the present invention. Also, references to "first end" and "second end" are intended to be for orientation purposes and the references in the figures to such ends are not to be taken literally, e.g. for example, the meaning and intent of "first end" and/or "second end" should be understood as the "general" ends of the members even though/if the reference lines in the figures may or may not be pointing to the exact end of the member so referenced.

As thus should now be understood by those skilled in the art, the present invention overcomes all of the aforementioned deficiencies while also providing the advantages mentioned herein as well as those advantages that should be understood by those skilled in the art.

Other advantages and objectives are deemed to be apparent from the disclosure herein. It should also be appreciated that the present invention can be implemented and utilized in numerous ways. While the present invention has been described with respect to preferred embodiments, those skilled in the art will readily appreciate that various changes and/or modifications can be made to the invention without departing from the spirit or scope of the invention.

What is claimed is:

1. An umbrella assembly comprising:

a central shaft, the central shaft having a first end and a second end opposite the first end;

a canopy coupled to the first end of the central shaft;

an auger extending from the second end of the central shaft;

a collar/hub nonslideably coupled to the central shaft and spaced from the auger;

a plurality of legs, each of the plurality of legs having a first end and a second end;

wherein the first end of each of the plurality of legs is coupled to the collar/hub, the second end of each of the plurality of legs extends towards the auger, and the collar/hub remains in a fixed position with respect to the central shaft when the second end of each leg extends outwardly from the central shaft to a deployed position and returns downwardly towards the central shaft from its deployed position to a stowed position; and a flexible material having an opening through which the central shaft extends and wherein the second end of each leg is coupled to the flexible material.

2. The umbrella assembly as claimed in claim 1, wherein when the second ends of the respective legs are in each of their respective deployed positions and the flexible material in an open position, the flexible material is intermediate the auger and the collar/hub.

3. The umbrella assembly as claimed in claim 1, further comprising a first shaft having a first end and a second end, wherein the canopy is coupled to the first end of the first shaft and wherein the second end of the first shaft is coupled to the first end of the central shaft.

4. The umbrella assembly as claimed in claim 1, wherein the canopy is directly coupled to the first end of the central shaft.

5. The umbrella assembly as claimed in claim 1, wherein the collar/hub comprises a plurality of leg receptacles extending from the collar/hub, each of the plurality of leg receptables being associated with one of the legs of the plurality of legs;

wherein each leg receptacle includes a pin extending therethrough, upon which the leg associated with the leg receptacle is coupled so as to permit the associated leg to be extended outwardly and returned towards the shaft.

6. The umbrella assembly as claimed in claim 1, wherein (i) extension of the plurality of legs outwardly from the central shaft to their respective deployed positions extends the flexible material to an open position; and (ii) returning of the plurality of legs towards the central shaft to their respective stowed positions causes the flexible material to return to a collapsed position.

7. The umbrella assembly as claimed in claim 1, wherein the canopy is a beach umbrella.

8. The umbrella assembly as claimed in claim 1, wherein the second end of each leg is coupled to the flexible material about the perimeter of the flexible material.

9. The umbrella assembly as claimed in claim 1, wherein the flexible material includes one or more sidewalls to facilitate retention of material on the flexible material within an area bounded by the sidewall(s).

10. The umbrella assembly as claimed in claim 9, wherein the one or more sidewalls extend along the entire perimeter of the flexible material.

11. The umbrella assembly as claimed in any claim 1, wherein the flexible material is made of fabric, plastic, and/or a combination thereof.

12. An umbrella stability assembly for use with a canopy, wherein the umbrella stability assembly comprises a shaft and wherein the canopy is coupled to one end of the shaft, and an auger coupled to an other end of the shaft; wherein the umbrella stability assembly comprises:

a collar/hub nonslideably coupled to the shaft and spaced from the auger;

a plurality of legs, each of the plurality of legs having a first end and a second end;

wherein the first end of each of the plurality of legs is coupled to the collar/hub, the second end of each of the plurality of legs extends towards the auger, and the collar/hub remains in a fixed position with respect to the central shaft when the second end of each leg extends outwardly from the central shaft to a deployed position and returns downwardly towards the shaft from its deployed position to a stowed position; and a flexible material having an opening through which the shaft extends and wherein the second end of each leg is coupled to the flexible material.

13. The umbrella stability assembly as claimed in claim 12, wherein (i) extension of the plurality of legs outwardly from the shaft to their respective deployed positions extends the flexible material to an open position; and (ii) returning of the plurality of legs towards the shaft to their respective stowed positions causes the flexible material to return to a collapsed position.

14. The umbrella stability assembly as claimed in claim 12, wherein the second end of each leg is coupled to the flexible material about the perimeter of the flexible material.

15. The umbrella stability assembly as claimed in claim 12, wherein when the second ends of the respective legs are in each of their respective deployed positions and the flexible material in its open position, the flexible material is intermediate the auger and the collar/hub.

16. The umbrella stability assembly as claimed in claim 12, wherein the flexible material includes one or more sidewalls to facilitate retention of material on the flexible material within an area bounded by the sidewall(s).

17. The umbrella stability assembly as claimed in claim 16, wherein the one or more sidewalls extend along the entire perimeter of the flexible material.

18. The umbrella assembly as claimed in claim 12, wherein the collar/hub comprises a plurality of leg receptacles extending from the collar/hub, each of the plurality of leg receptables being associated with one of the legs of the plurality of legs;

wherein each leg receptacle includes a pin extending therethrough, upon which the leg associated with the leg receptacle is coupled so as to permit the associated leg to be extended outwardly and returned towards the shaft.

* * * * *